US009199776B1

(12) United States Patent
Bruce

(10) Patent No.: US 9,199,776 B1
(45) Date of Patent: Dec. 1, 2015

(54) THEFT RESISTANT PRODUCT PACKAGING

(71) Applicant: Miles R. Bruce, Upland, CA (US)

(72) Inventor: Miles R. Bruce, Upland, CA (US)

( * ) Notice: Subject to any disclaimer, the term of this patent is extended or adjusted under 35 U.S.C. 154(b) by 93 days.

(21) Appl. No.: 13/892,595

(22) Filed: May 13, 2013

Related U.S. Application Data

(60) Provisional application No. 61/801,371, filed on Mar. 15, 2013.

(51) Int. Cl.
*B65D 73/00* (2006.01)
*B65D 75/32* (2006.01)

(52) U.S. Cl.
CPC ..... *B65D 75/322* (2013.01)

(58) Field of Classification Search
CPC ..... B65D 75/322
USPC ..... 206/461, 467, 470, 471, 349; 220/4.23
See application file for complete search history.

(56) References Cited

U.S. PATENT DOCUMENTS

| | | | | |
|---|---|---|---|---|
| 3,833,742 | A * | 9/1974 | Wetmore et al. | 426/129 |
| 4,016,972 | A * | 4/1977 | Szamborski | 206/6.1 |
| 4,577,757 | A * | 3/1986 | Hustad et al. | 206/461 |
| 4,848,541 | A * | 7/1989 | Paliotta et al. | 206/471 |
| 8,088,421 | B2 * | 1/2012 | Hinze et al. | 426/106 |
| 8,307,982 | B1 * | 11/2012 | Vovan | 206/467 |
| 8,381,908 | B2 * | 2/2013 | Hansen et al. | 206/470 |
| 8,573,397 | B1 * | 11/2013 | Fager et al. | 206/469 |
| 2012/0318695 | A1 | 12/2012 | Seber | |

* cited by examiner

*Primary Examiner* — J. Gregory Pickett
*Assistant Examiner* — Jennifer N Zettl
(74) *Attorney, Agent, or Firm* — Eric Karich; Karich & Associates

(57) ABSTRACT

A theft resistant product packaging has a rear shell, a middle shell, and a front shell for containing a product. The front and rear shells have cut resistant contours for resisting cuts therethrough. The middle shell abuts the rear shell such that they may contain the product therebetween. The front shell covers the middle shell such that cut resistant contours of the front shell nest within the cut resistant contours of the middle shell, thereby cooperating to prevent cutting through the front shell to remove the product.

15 Claims, 11 Drawing Sheets

THEFT RESISTANT PRODUCT PACKAGING

CROSS-REFERENCE TO RELATED APPLICATIONS

This application for a utility patent claims the benefit of U.S. Provisional Application No. 61/801,371, filed Mar. 15, 2013.

BACKGROUND OF THE INVENTION

1. Field of the Invention

This invention relates generally to product packaging, and more particularly to theft resistant product packaging.

2. Description of Related Art

Product packaging contains a product and displays it to the consumer for purchase. For many products it is important that the product packaging impede theft of the product; however, due to the display function of the packaging, it remains important that the product packaging look attractive and enticing to the consumer. Also, as with all components of a product, it is always desirable to provide these functions for a reasonable price.

The prior art teaches the use of thermoformed plastic "clamshell" packaging. This form of packaging is popular because it looks attractive, displays the product well, and at a reasonable price. The disadvantage of this form of packaging is that it is relatively easy to slice the clamshell open to steal the product.

One alternative to prevent theft is to increase the thickness of the thermoformed plastic. This approach increases the cost of the packaging, and is still not strong enough to adequately prevent theft.

A more recent approach, illustrated in Seber et al., U.S. 2012/0318695, is to laminate a cut-resistant fiber into the thermoformed plastic. While this provides resistance to theft, the fibers are unattractive and impede the presentation of the product.

The prior art teaches various forms of thermoformed plastic clamshell packaging, and product packaging that includes cut resistant fibers. However, the prior art does not teach a product packaging that is both attractive and also a significant barrier to theft. The present invention fulfills these needs and provides further advantages as described in the following summary.

SUMMARY OF THE INVENTION

The present invention teaches certain benefits in construction and use which give rise to the objectives described below.

The present invention provides a theft resistant product packaging for containing a product. The theft resistant product packaging comprises a front shell having cut resistant contours for resisting cuts therethrough; a middle shell having cut resistant contours for resisting cuts therethrough; and a rear shell. The middle shell abuts the rear shell such that they may contain the product therebetween. The front shell covers the middle shell such that cut resistant contours of the front shell nest within the cut resistant contours of the middle shell, thereby cooperating to prevent cutting through the front shell to remove the product.

A primary objective of the present invention is to provide a theft resistant product packaging having advantages not taught by the prior art.

Another objective is to provide a theft resistant product packaging that resists cuts through the packaging to prevent theft of the product within the packaging.

A further objective is to provide a theft resistant product packaging that provides an attractive display of the product, without obscuring the view of the product with unsightly anti-theft fibers or similar features.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, theft resistant product packaging 10 for protecting a product 12 from theft while on display in a store or other retail location.

Figure 1:
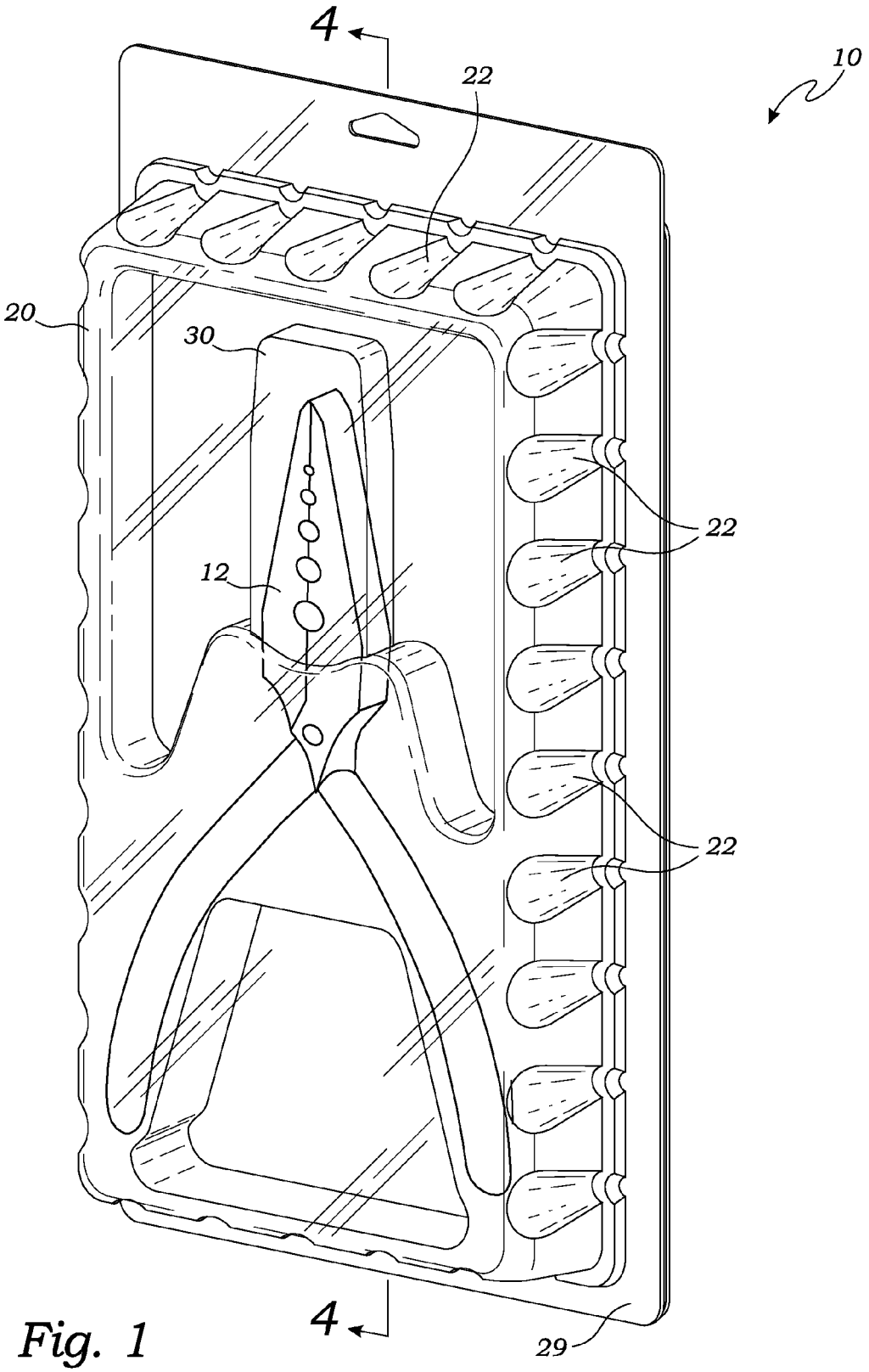
FIG. 1 is a perspective view of a theft resistant product packaging according to a first embodiment of the present invention.
Figure 2:
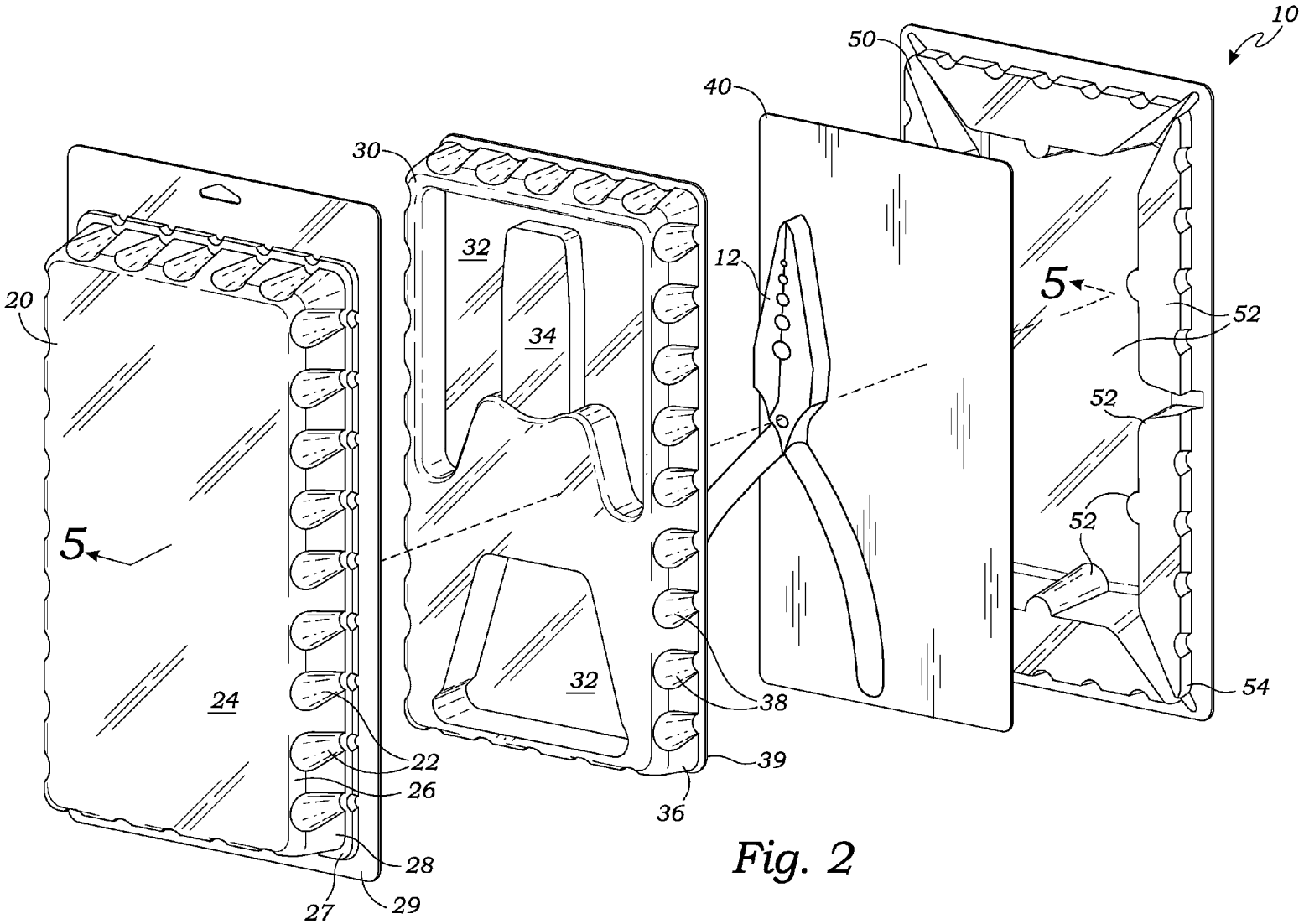
FIG. 2 is an exploded perspective view thereof, illustrating the components of the theft resistant product packaging, including a front shell, a middle shell, a product on a card insert, and a rear shell.
Figure 3:
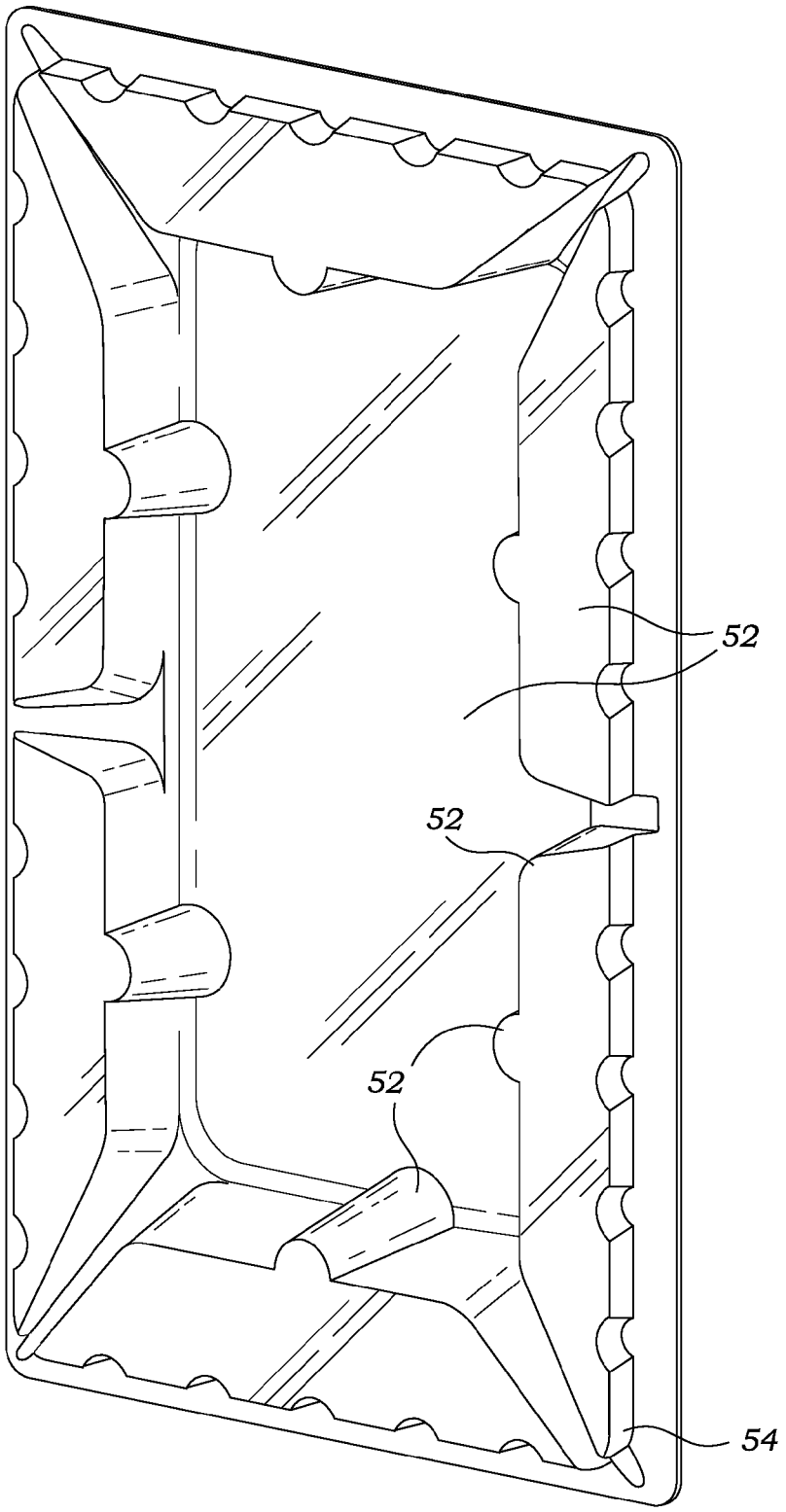
FIG. 3 is a perspective view of the rear shell of FIG. 2.
Figure 4:
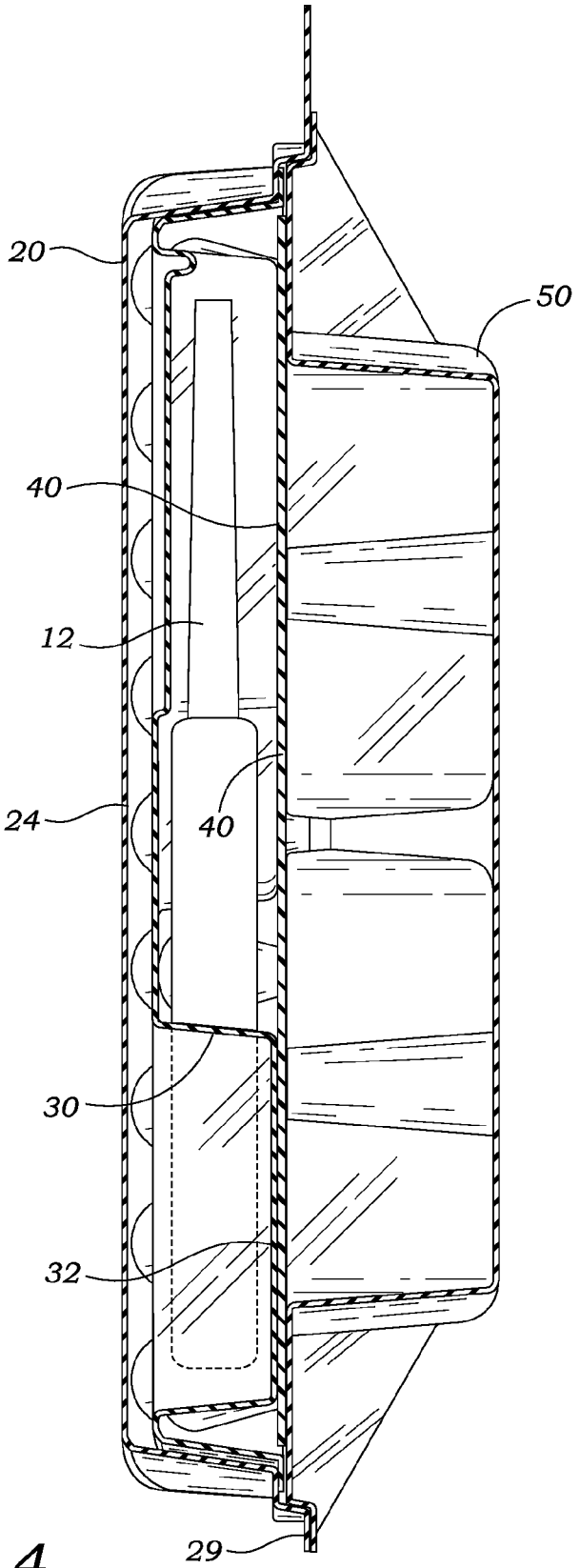
FIG. 4 is a sectional view thereof taken along line 4-4 in FIG. 1.
Figure 5:
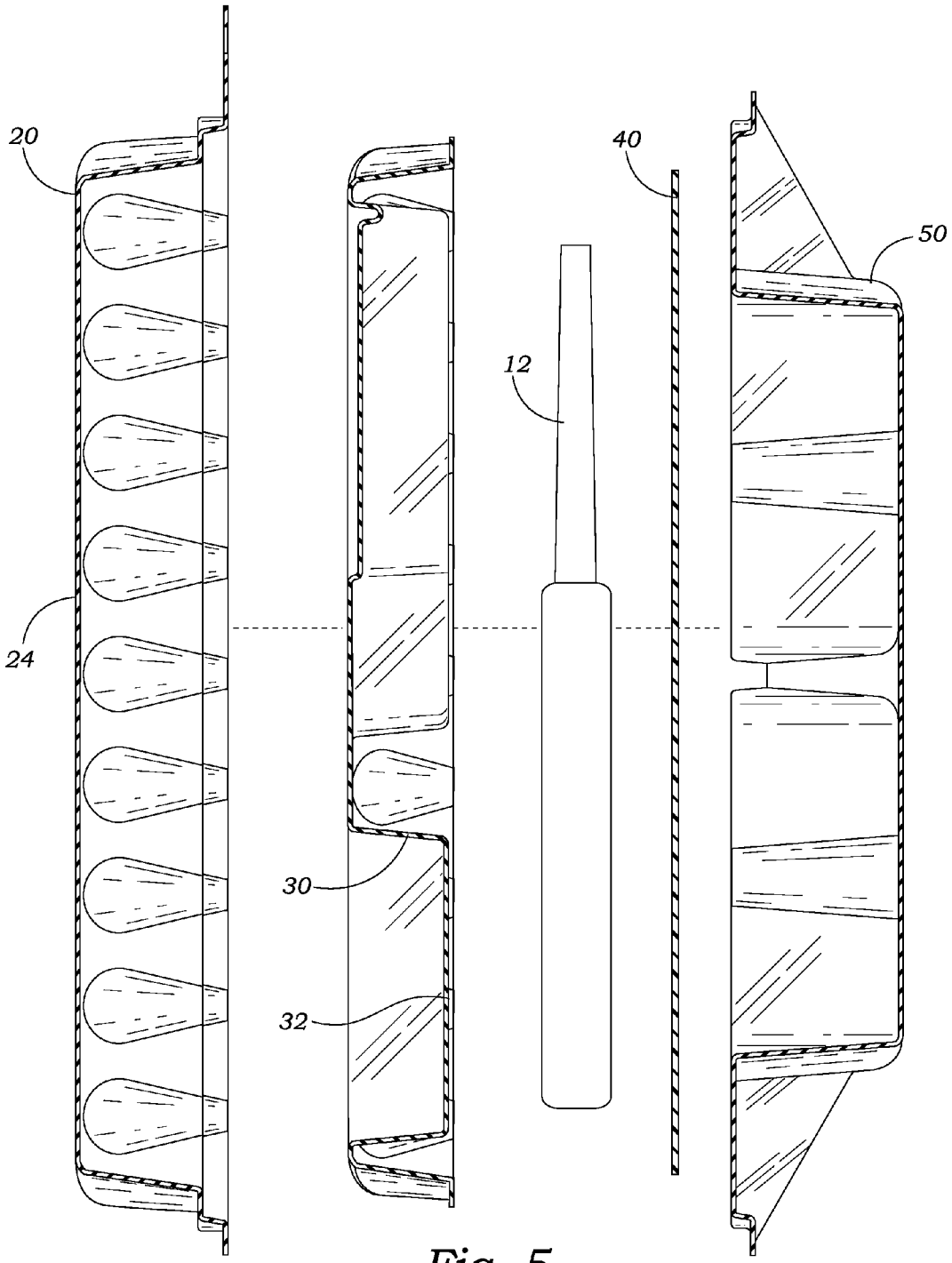
FIG. 5 is a sectional view thereof taken along line 5-5 in FIG. 2.

FIG. 1 is a perspective view of a first embodiment of the theft resistant product packaging 10. FIG. 2 is an exploded perspective view thereof, illustrating the components of the theft resistant product packaging 10, including a front shell 20, a middle shell 30, the product 12 on a card insert 40, and a rear shell 50. FIG. 3 is a perspective view of the rear shell 50 of FIG. 2. FIG. 4 is a sectional view thereof taken along line 4-4 in FIG. 1. FIG. 5 is a sectional view thereof taken along line 5-5 in FIG. 2.

As illustrated in FIGS. 1-5, in this embodiment the product packaging 10 includes the three shells 20, 30, and 50 that fit around the product 12 (and potentially the card insert 40 of similar packaging) and include cut resistant features, described below, to prevent theft of the product 12. The front shell 20 includes cut resistant contours 22 molded therein for resisting cuts through the front shell 20. In this embodiment, the front shell 20 includes a generally planar top surface 24 extending to a top perimeter 26, and a side wall 28 extending downwardly from the top perimeter 26 to a front attachment perimeter 29 that includes an outwardly extending flange 27. The cut resistant contours 22 of this embodiment are molded into the side wall 28 for resisting cuts through the side wall 28; however, the cut resistant contours 22 may also be included in any manner consistent with protecting the product 12 from theft, and those skilled in the art may device alternative arrangements that remain within the scope of the present invention.

In this embodiment, the top surface 24 is generally planar to permit easy viewing of the product 12 within the product packaging 10, although this too may be varied depending upon the design of one skilled in the art. In an alternative embodiment, the cut resistant contours 22 may extend entirely around the front shell 20, including the top surface 24, and may include curves similar to those shown, and/or alternative cut-resistant shapes (e.g., the V-grooves described below, and/or any other shapes with similar cut-resistant qualities). The cut resistant contours 22 may also extend to the top perimeter 26, and even to the flange 27; and these contours 22 may interlock with the rear shell 50. The particular shape, design, configuration of the cut resistant contours 22 may vary, and these and other alternative embodiments are within the scope of the present invention In the embodiment of FIGS. 1-5, the middle shell 30 is shaped for generally conform to the product 12 for holding the product 12 against the rear shell 50 (or the card insert 40). In one embodiment, a portion 32 of the middle shell 30 abuts the rear shell 50 and/or the card insert 40. In this embodiment, the portion 32 of the middle shell 30 abuts the card insert 40, but in other embodiments discussed below it may abut (i.e., contact, or be physically located near, even if another element is positioned therebetween) the rear shell 50. The middle shell 30 prevents the extraction of the product 12 from the product packaging in the event that the front shell 20 is cut open, especially through the top surface 24 of the front shell 20, which in this embodiment does not include cut resistant contours 22 molded therein.

In this embodiment, the middle shell 30 also includes a product cover portion 34 that is shaped to generally conform to the product 12, to prevent removal of the product 12 as discussed above. The middle shell 30 may extend to a downwardly extending side wall 36 that includes cut resistant contours 38 for resisting cuts through the downwardly extending side wall 28. The side wall 36 extends to a perimeter 39 that may include an outwardly extending flange 37 or other suitable shape for abutting the front shell 20 and/or the rear shell 50.

The cut resistant contours 22 and 38 of the middle shell 30 and the front shell 20 may nest together to create a secure assembly, and to also provide packaging having twice the thickness of the individual components, so that a potential thief will have to cut through the combined front and middle shells to access the product 12 therethrough. In this embodiment, the cut resistant contours 22 and 38 are formed in the side walls 28 and 36 (or other portion) of the front shell 20 and the middle shell 30, and may be in the form of a scalloped cross-section, although alternative and/or equivalent shapes may also be used in alternative embodiments. While the scalloped cross-section is illustrated, alternative forms of curves, C-shapes, V-shapes, crenulated portions, and/or combinations of other suitable shapes may be used, as long as they make cutting the shells difficult, noisy, or otherwise deter cutting of the shell(s) and theft of the product 12.

The card insert 40 may be any form of sheet, typically made of cardboard or other suitable material, and printed with information about the product 12 (e.g., photos of the product, the trademark, information about the product, illustrations of the use of the product, etc.). The product 12 may or may not be fastened to the card insert 40, and those skilled in the art may devise alternative constructions, or the card insert 40 may be omitted, or replaced with alternative structures.

The rear shell 50 includes extensive cut resistant contours 52 molded into the rear shell 50 for resisting cuts through the rear shell 50. In the embodiment of FIGS. 1-5, the cut resistant contours 52 of the rear shell 50 are disposed throughout the rear shell 50, in this case in the form of a generally dome-shaped structure 56 with various three dimensional shapes 58 formed therein. In this embodiment, the three dimensional shapes 58 include a plurality of scalloped portions, although various curves, buttresses, scallops, and other shapes may be included to prevent cutting through the rear shell 50 for removal of the product. Since the rear shell 50 is hidden behind the product 12 and/or the card insert 40 when on display, the appearance of the rear shell 50 is not as important as the front shell 20, and the product 12 does not have to be clearly visible through the rear shell 50.

The rear shell 50 extends to a rear attachment perimeter 54 that enables the connection of the front and rear shells 20 and 50 (either directly, or with the middle shell 30 therebetween). The rear attachment perimeter 54 may further include perimeter scallops 55 that are shaped to nest with the cut resistant contours 22 and 38 of the middle shell 30 and the front shell 20. The front attachment perimeter 29 and the rear attachment perimeter 54 may be shaped to be jointed together so that the front shell 20 and the rear shell 50 together surround and contain the middle shell 30 and the product 12.

Figure 6:
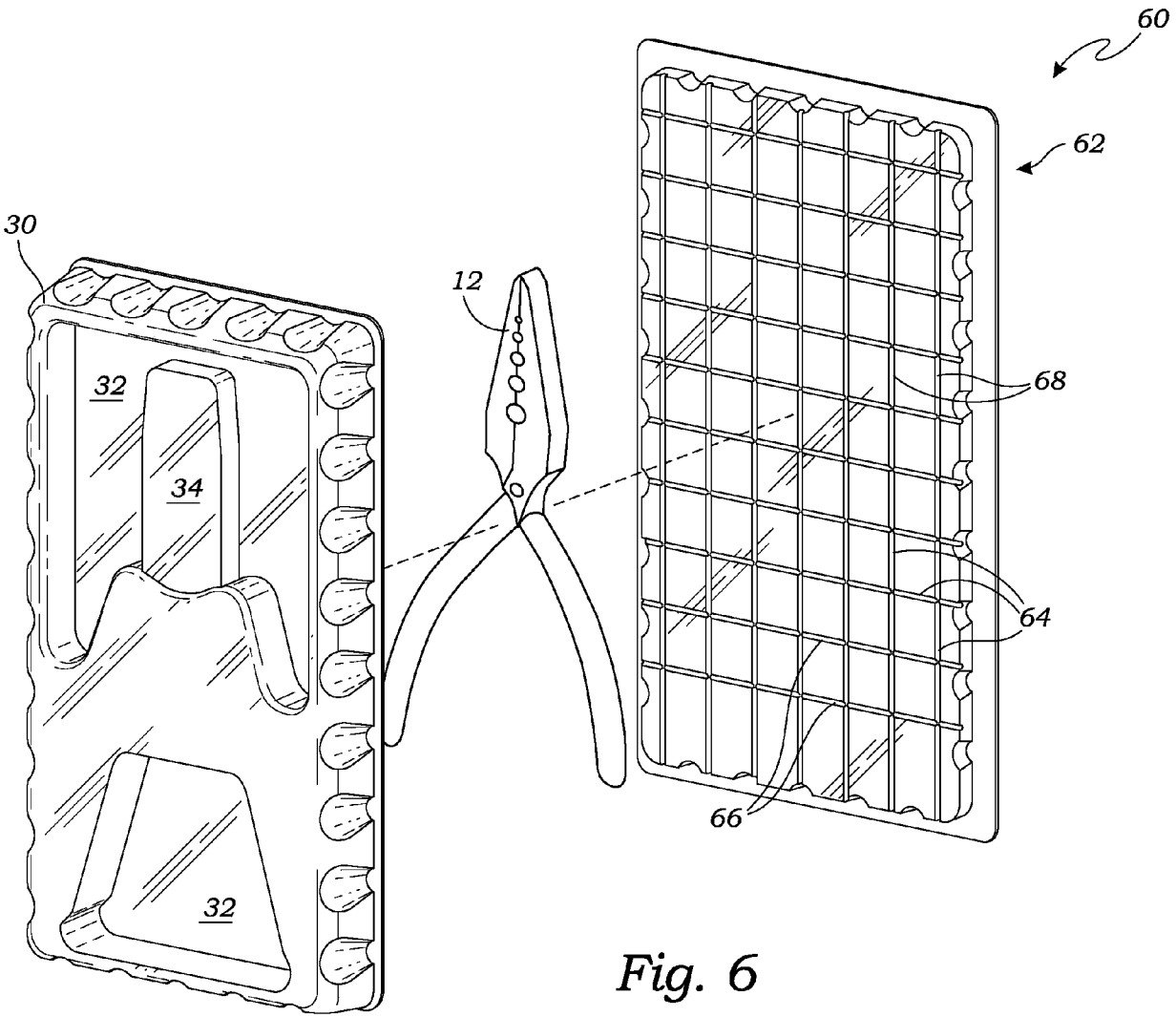
FIG. 6 is an exploded perspective view of a second embodiment of the theft resistant product packaging that only includes the middle shell and an alternative embodiment of the rear shell.

FIG. 6 is an exploded perspective view of a second embodiment of the theft resistant product packaging 60 that only includes the middle shell 30 and an alternative embodiment of the rear shell 62. As illustrated in FIG. 6, in some embodiments the product packaging 60 does not include the top shell. In this embodiment, the rear shell 50 includes a lattice of molded grooves 64 formed across the rear shell, to impede cuts through the rear shell. The lattice may include lateral grooves 66 and longitudinal grooves 68 that intersect at approximately right angles, or the grooves 64 may have another configuration, as long as they are suitably resistant to cuts. This embodiment may or may not include the card insert 40 (illustrated in FIGS. 1-5).

Figure 7:
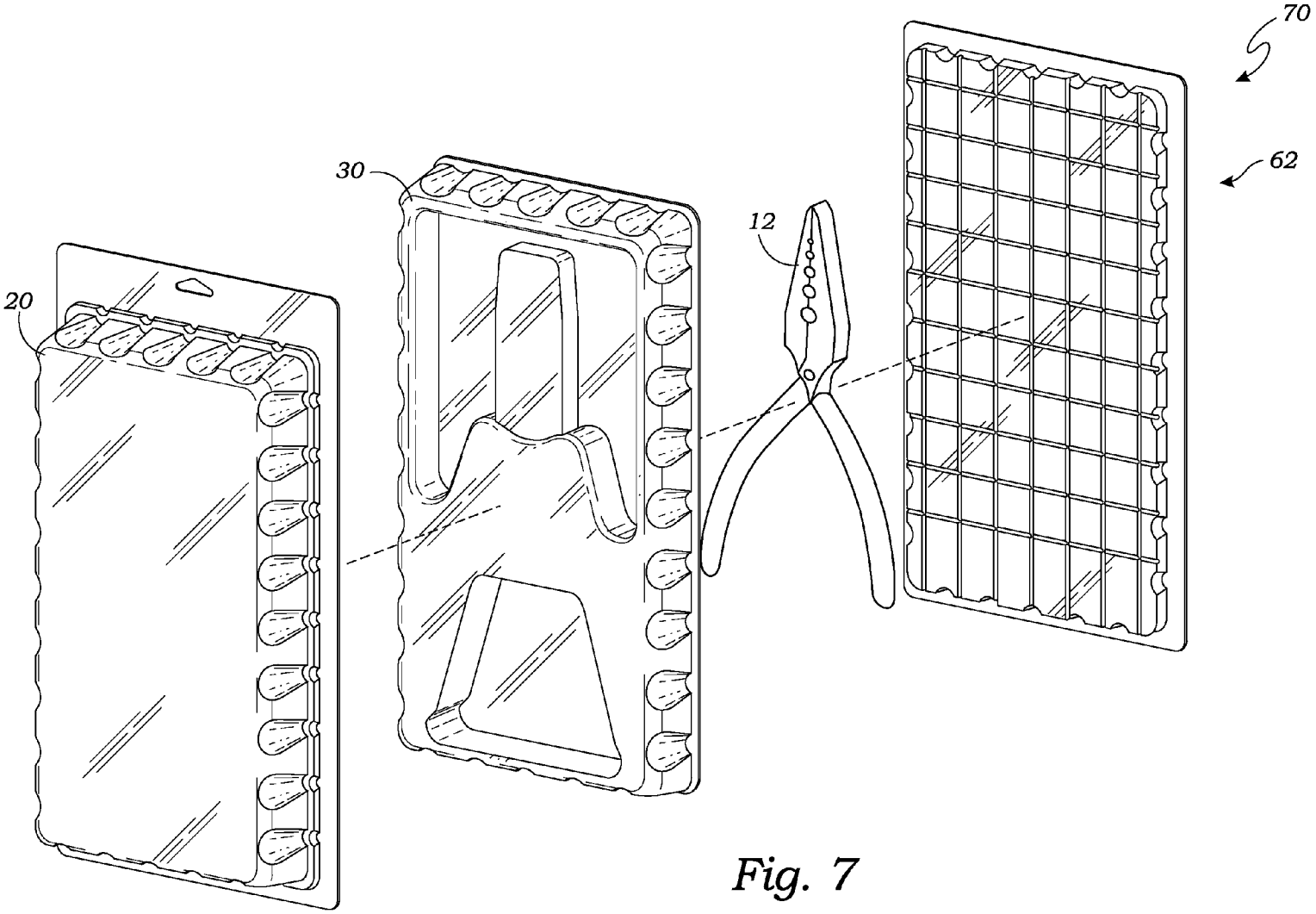
FIG. 7 is an exploded perspective view of a third embodiment of the theft resistant product packaging, similar to FIG. 6, only also including the front shell.
Figure 8:
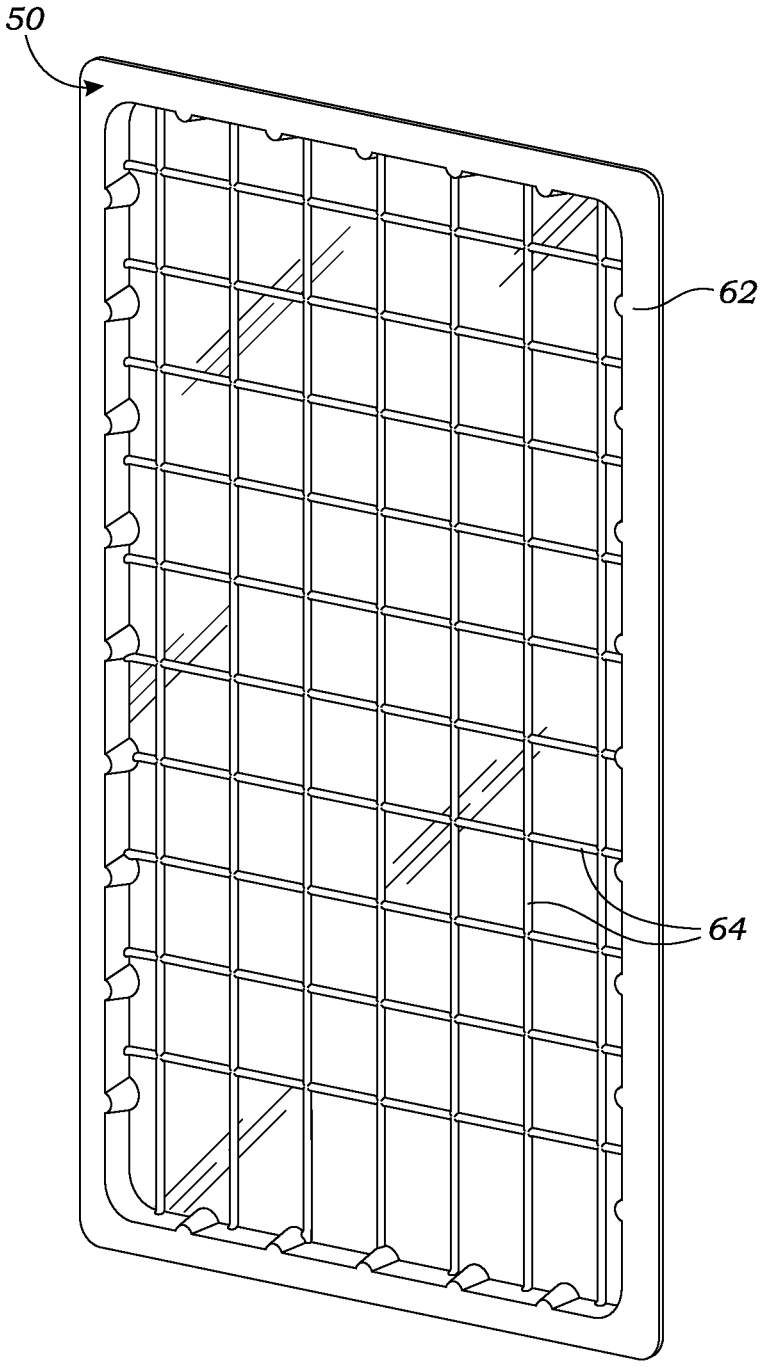
FIG. 8 is a rear perspective view of the rear shell of FIGS. 6 and 7.

FIG. 7 is an exploded perspective view of a third embodiment of the theft resistant product packaging 70, similar to FIG. 6, only also including the front shell 20. FIG. 8 is a rear perspective view of the rear shell 50 of FIGS. 6 and 7, further illustrating the lattice of molded grooves.

Figure 9:
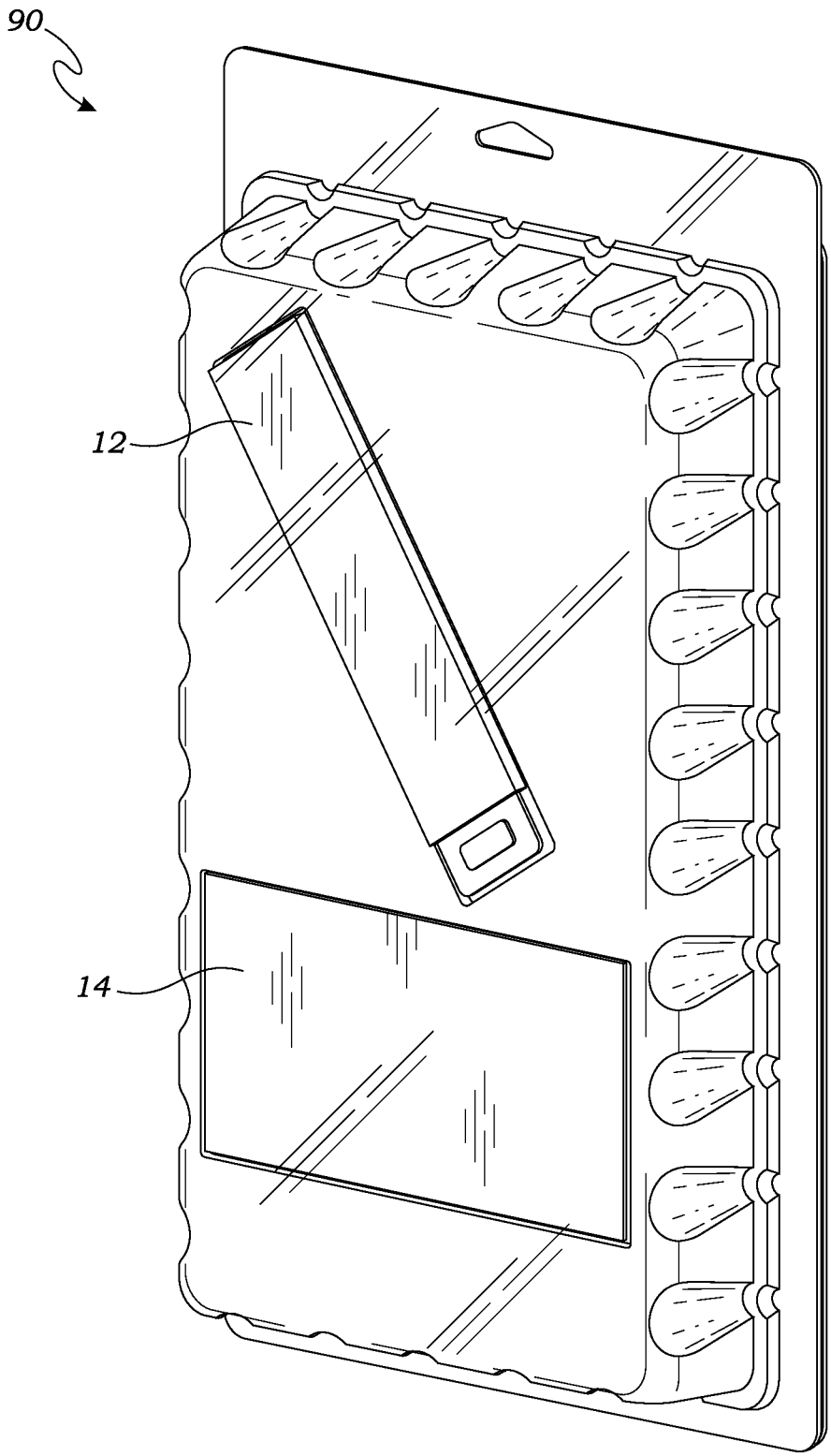
FIG. 9 is a perspective view of a fourth embodiment of the theft resistant product packaging.
Figure 10:
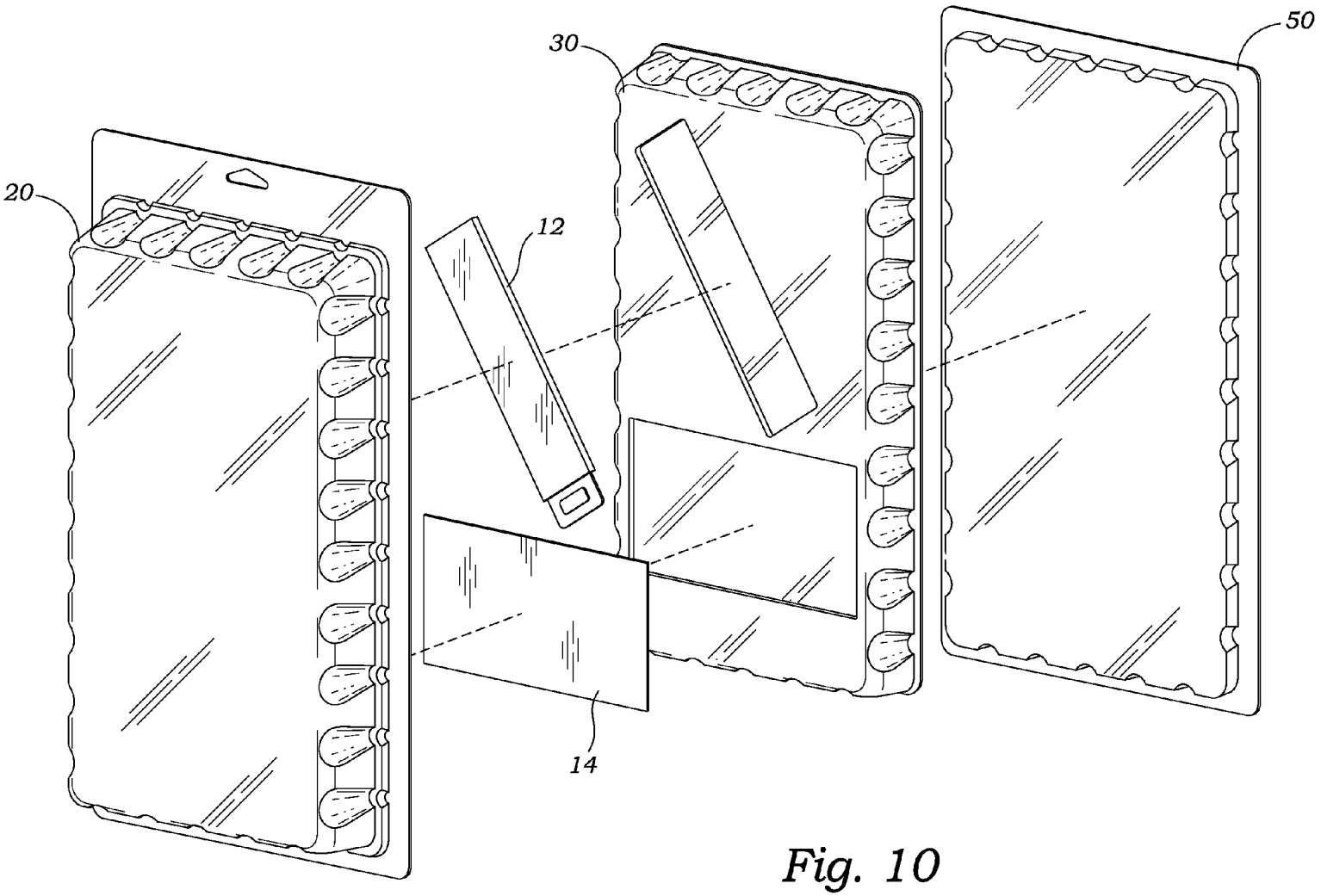
FIG. 10 is an exploded perspective view thereof.

FIG. 9 is a perspective view of a fourth embodiment of the theft resistant product packaging 90. FIG. 10 is an exploded perspective view thereof. As illustrated in FIGS. 9-10, this embodiment is similar to the first embodiment of FIGS. 1-5, only the middle shell 30 is shaped to hold the product 12 against the front shell 20. This embodiment further illustrates the option of including other elements, in this case printed advertisements 14 or similar materials, operably positioned in the product packaging 90.

Figure 11:
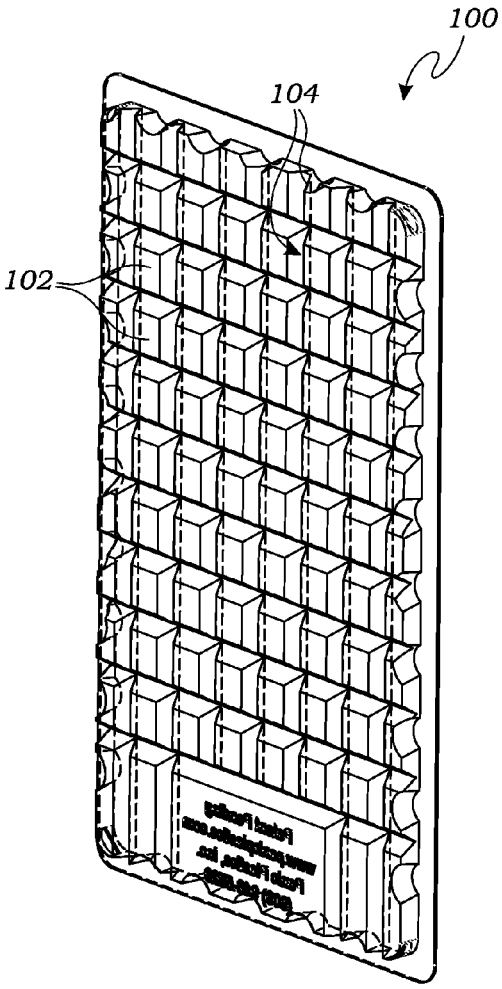
FIG. 11 is a perspective view of another embodiment of the rear shell.
Figure 12:
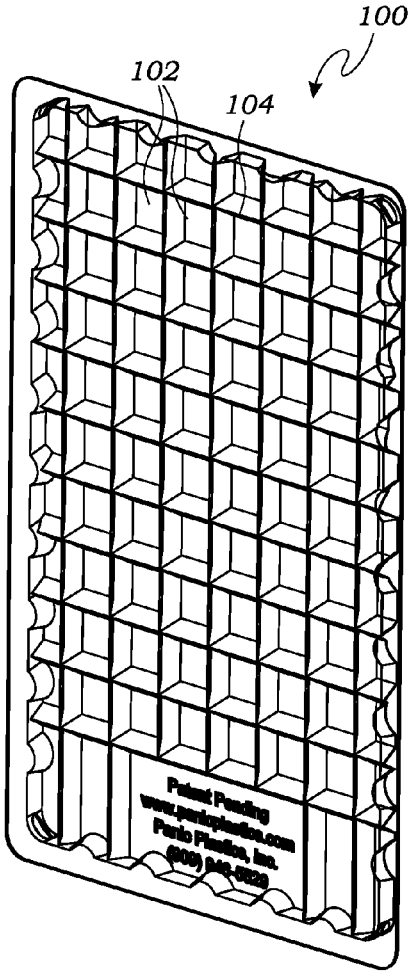
FIG. 12 is a rear perspective view thereof.

FIG. 11 is a perspective view of another embodiment of the rear shell 100. FIG. 12 is a rear perspective view thereof. As illustrated in FIGS. 11-12, this embodiment is similar to the rear shell 50 of FIGS. 6-8, only instead of molded grooves, a plurality of boxes 102 separated by V-shaped grooves 104 are thermoformed into the rear shell 50 to provide even further resistance to attempts to cut the product packaging.

The V-shaped grooves 104 formed between the boxes make it very difficult to cut through, and also make the process very noisy, further dissuading theft. The V-shaped grooves 104 have an acute angle and extend to a depth sufficient to significantly impede cutting attempts.

The product packaging may be formed using standard thermoforming processes, using standard materials known in the art (e.g., PVC, APET, RPET, PETG, RPETG, polystyrene, acrylics, PLA, and others known in the art.) The product packaging may also be formed in standard thicknesses, typically 0.010-0.050 inch, preferably 0.020-0.030 inch, although other thicknesses may also be used if desired.

For purposes of this application, the terms "front," "middle," and "rear" are for labeling convenience only, and do not require that the component be located in a particular orientation; i.e., the front does not have to form the front of the product packaging, the rear does not have to form the rear of the product packaging, and the middle does not have to be between anything. If all three components are included, however, the middle is located between the front and the rear.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A theft resistant product packaging for containing a product, the theft resistant product packaging comprising:

a rear shell that includes cut resistant contours molded into the rear shell for resisting cuts through the rear shell, the rear shell extending to a rear attachment perimeter;

a middle shell having a product cover portion that is shaped to fit over and contain the product, the product cover portion extending to a downwardly extending side wall that includes cut resistant contours for resisting cuts through the downwardly extending side wall, the downwardly extending side wall extending to a middle attachment perimeter;

the middle and front attachment perimeters being shaped to be jointed together so that the middle and rear shells surround and contain the product; and further comprising a front shell having a top surface extending to a top perimeter, a side wall extending downwardly from the top perimeter to a front attachment perimeter, wherein the cut resistant contours of the rear shell include a lattice of molded grooves that are shaped to prevent cuts through the rear shell.

2. The theft resistant product packaging of claim 1, further comprising cut resistant contours molded into the side wall of the front shell for resisting cuts therethrough.

3. The theft resistant product packaging of claim 2, wherein the front shell, the middle shell, and the rear shell are formed of thermoformed plastic.

4. The theft resistant product packaging of claim 1, wherein the cut resistant contours of the middle shell are formed via the downwardly extending side wall having a scalloped cross-section.

5. The theft resistant product packaging of claim 1, wherein the cut resistant contours of the rear shell include a generally dome-shaped structure with various three-dimensional shapes formed therein to prevent cuts through the rear shell.

6. A theft resistant product packaging for containing a product, the theft resistant product packaging comprising:

a thermoformed plastic front shell having a top surface extending to a top perimeter, a side wall extending downwardly from the top perimeter to a front attachment perimeter;

cut resistant contours molded into the side wall of the thermoformed plastic front shell for resisting cuts therethrough;

a thermoformed plastic rear shell that includes cut resistant contours molded into the rear shell for resisting cuts through the rear shell, the rear shell extending to a rear attachment perimeter;

a thermoformed plastic middle shell having a product cover portion that extends to a downwardly extending side wall that includes cut resistant contours for resisting cuts through the downwardly extending side wall of the thermoformed plastic middle shell, the product cover portion being shaped to fit over and generally conform to the product;

the front and rear attachment perimeters being shaped to be jointed together so that the front and rear shells surround and contain the middle shell and the product, such that the middle shell nests within the front shell and the side wall of the front shell abuts the downwardly extending side wall of the middle shell, and such that the cut resistant contours of the side wall nest within the cut resistant contours of the downwardly extending side wall of the middle shell, thereby cooperating to prevent theft of the product, wherein the cut resistant contours of the rear shell include a lattice of molded grooves that are shaped to prevent cuts through the rear shell.

7. The theft resistant product packaging of claim 6, wherein the cut resistant contours of the middle shell are formed via the downwardly extending side wall having a scalloped cross-section.

8. The theft resistant product packaging of claim 7, wherein the cut resistant contours of the rear shell include a generally dome-shaped structure with various three-dimensional shapes formed therein to prevent cuts through the rear shell.

9. The theft resistant product packaging of claim 8, wherein the three-dimensional shapes formed in the generally dome-shaped structure include a plurality of scalloped portions.

10. The theft resistant product packaging of claim 6, wherein a portion of the product cover portion abuts the rear shell.

11. The theft resistant product packaging of claim 6, further comprising a card insert positioned between the product and the rear shell, and wherein a portion of the product cover portion of the middle shell abuts the card insert.

12. A theft resistant product packaging for containing a product, the theft resistant product packaging comprising:

a front shell having cut resistant contours for resisting cuts therethrough;

a middle shell having cut resistant contours for resisting cuts therethrough;

a rear shell;

the middle shell abutting the rear shell such that they may contain the product therebetween;

the front shell covering the middle shell such that cut resistant contours of the front shell nest within the cut resistant contours of the middle shell, thereby cooperating to prevent cutting through the front shell to remove the product, wherein the cut resistant contours of the rear shell include a lattice of molded grooves that are shaped to prevent cuts through the rear shell.

13. The theft resistant product packaging of claim 12, wherein the rear shell includes a generally dome-shaped structure with various three-dimensional shapes formed therein to prevent cuts through the rear shell.

14. The theft resistant product packaging of claim 12, wherein the lattice of molded grooves includes lateral grooves and longitudinal grooves.

15. The theft resistant product packaging of claim 12, wherein the cut resistant contours have a scalloped cross-section.

* * * * *